US007819241B2

(12) United States Patent
Post-Smith et al.

(10) Patent No.: US 7,819,241 B2
(45) Date of Patent: Oct. 26, 2010

(54) PRE-FILLED CONTACT LENS CONTAINER

(75) Inventors: Julie Irene Post-Smith, Broadview Heights, OH (US); Paula Michele Fite, Webster Groves, MO (US); Matthew John Smith, Broadview Heights, OH (US); Luke Hillenbrecht, Kent, OH (US)

(73) Assignee: FPS Products, Inc., Broadview Heights, OH (US)

( * ) Notice: Subject to any disclaimer, the term of this patent is extended or adjusted under 35 U.S.C. 154(b) by 4 days.

(21) Appl. No.: 12/348,667

(22) Filed: Jan. 5, 2009
(Under 37 CFR 1.47)

(65) Prior Publication Data

US 2009/0200182 A1 Aug. 13, 2009

Related U.S. Application Data

(60) Provisional application No. 61/019,119, filed on Jan. 4, 2008.

(51) Int. Cl.
*A45C 11/04* (2006.01)

(52) U.S. Cl. ..... 206/5.1

(58) Field of Classification Search ..... 206/5.1; 15/104.92, 104.93; 134/901
See application file for complete search history.

(56) References Cited

U.S. PATENT DOCUMENTS

| | | | | | |
|---|---|---|---|---|---|
| 3,741,377 | A * | 6/1973 | Krellen | 206/5.1 |
| 4,691,820 | A | 9/1987 | Martinez | |
| 5,375,698 | A | 12/1994 | Ewart et al. | |
| 5,515,964 | A * | 5/1996 | Bauman | 206/5.1 |
| 5,657,506 | A * | 8/1997 | Pankow | 15/104.92 |
| 5,697,495 | A * | 12/1997 | Abrams et al. | 206/5.1 |
| 6,138,312 | A * | 10/2000 | Cummings | 15/104.92 |
| RE37,558 | E * | 2/2002 | Abrams et al. | 206/5.1 |
| 7,395,575 | B1 * | 7/2008 | Webb et al. | 15/104.92 |
| 7,416,077 | B2 * | 8/2008 | Kataoka et al. | 206/5.1 |

* cited by examiner

*Primary Examiner*—Bryon P Gehman
(74) *Attorney, Agent, or Firm*—Zollinger & Burleson Ltd

(57) ABSTRACT

A pre-filled contact lens container is provided with at least a single sealed receptacle at least partially filled with multi-purpose lens cleaning solution. The container includes a lid that snap fits to the base to seal the receptacle after the receptacle seal has been removed. A person uses the container by removing the seal to expose the solution in the receptacle, placing a lens in the solution, and sealing the receptacle with the lid of the container. The container may be provided in pairs or groups so that multiple lenses may be stored and cleaned. The individual containers may be provided in the form of a perforated sheet so that the user may tear off the number of containers to be used.

13 Claims, 9 Drawing Sheets

PRE-FILLED CONTACT LENS CONTAINER

CROSS REFERENCE TO RELATED APPLICATIONS

This application claims the benefit of U.S. Provisional Patent Application Ser. No. 61/019,119 filed Jan. 4, 2008; the disclosures of which are incorporated by reference.

BACKGROUND OF THE INVENTION

1. Technical Field

The present invention generally relates to containers and, more particularly, to containers for optical contact lenses. Specifically, the present invention relates to a sealed, fluid-filled contact lens container wherein the seal may be removed and contact lenses may be placed in the container. The lenses then may be sealed inside the container by closing a lid of the container with a liquid-tight snap fit.

2. Background Information

Many of today's contact lenses are worn for multiple days until they are discarded for a new pair. Such lenses must be cleaned between uses. Lenses are cleaned by soaking them in a multi-purpose liquid solution that cleans and disinfects after a few hours. The standard container for storing the lenses during this cleaning period is a two-receptacle container having a pair of threaded lids. The user fills each receptacle with the liquid solution and then places the lenses in the receptacle. The lids are screwed on and the container is set aside for the requisite time period. A drawback with this system is the inconvenience of carrying both the liquid cleaning solution and the two-receptacle container. In order to reduce the cost of the liquid solution, users purchase large containers that are inconvenient to pack while traveling. Travelers thus desire a pre-filled contact lens storage container that is convenient and disposable.

BRIEF SUMMARY OF THE INVENTION

The invention provides a pre-filled contact lens container. In one configuration, the container is provided with a single sealed receptacle at least partially filled with multi-purpose lens cleaning solution. The container includes a lid that snap fits to the base to seal the receptacle after the receptacle seal has been removed. A person uses the container by removing a seal to expose the solution in the receptacle, placing a lens in the solution, and sealing the receptacle with the lid of the container. The container may be provided in pairs or groups so that multiple lenses may be stored and cleaned. The individual containers may be provided in the form of a perforated sheet so that the user may tear off the number of containers to be used.

In one configuration, the invention provides a pre-filled contact lens container having a base defining at least one contact lens receptacle; a contact lens multi-purpose solution disposed in receptacle; a removable single-use, receptacle seal connected to the base to seal the contact lens multi-purpose solution in the receptacle; a lid pivotably connected to the base about a living hinge between an open condition and a closed condition with respect to the base; and the lid cooperating with the base when the lid is in the closed position to seal the receptacle after the removable, single-use, receptacle seal has been removed.

Another configuration of the invention provides a pre-filled contact lens container including a base defining a first contact lens receptacle and a second contact lens receptacle; the second contact lens receptacle being pivotably connected to the first contact lens receptacle; a contact lens multi-purpose solution disposed in the first and second contact lens receptacles; a lid pivotably connected to the base; the lid being movable between an open condition and a closed condition with respect to the base; and the first lid cooperating with the base when the first lid is in the closed position to seal the first and second contact lens receptacles with the lid sandwiched between the first and second contact lens receptacles.

A further configuration of the invention provides a pre-filled contact lens container including: a first base defining at least a first contact lens receptacle; a contact lens multi-purpose solution disposed in the first contact lens receptacle; the first base including a landing annular portion surrounding the receptacle; the first base defining a ring-shaped depression surrounding the landing annular portion; a removable single-use, receptacle seal connected to the base to seal the contact lens multi-purpose solution in the first contact lens receptacle; a first lid pivotably connected to the base and movable between an open condition and a closed condition with respect to the base; and the first lid defining a ring-shaped protrusion configured to snap fit into the ring-shaped depression of the first base to secure the first lid in the closed condition and seal the first contact lens receptacle.

The base portions of these configurations may be configured with notched sidewalls to allow the lid to snap fit to the base to provide a secured and sealed connection.

A clip may be provided to hold these configurations in the closed configurations.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
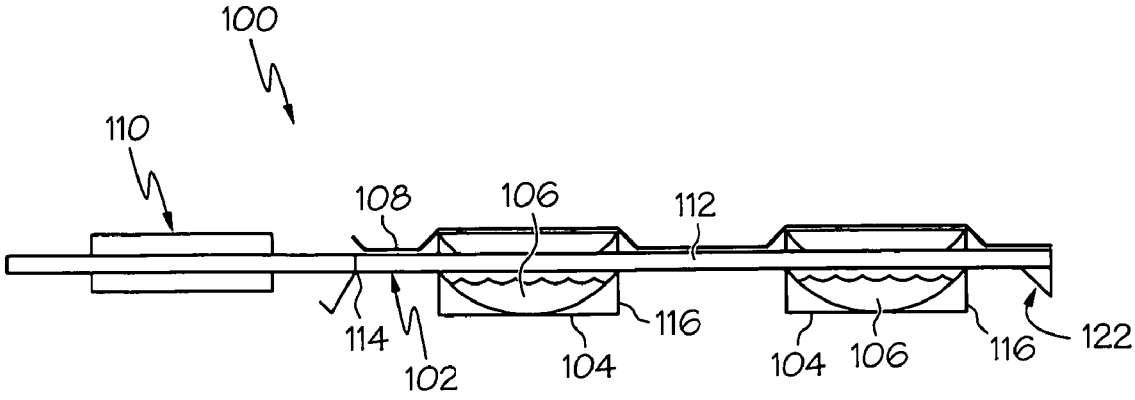
FIG. 1 is a side view of a first embodiment of the invention.
Figure 2:
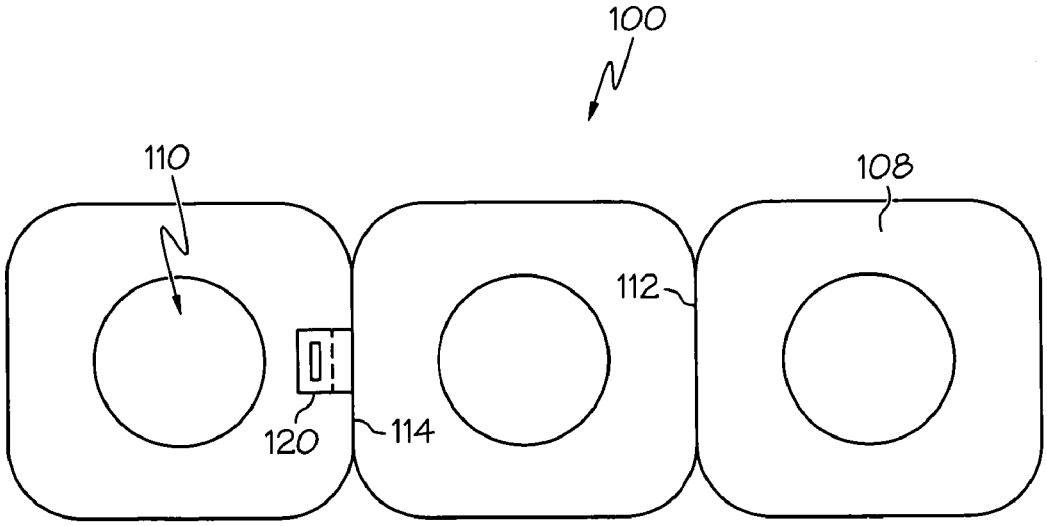
FIG. 2 is a top plan view of the first embodiment of the invention.

The first configuration of the container of the invention is indicated generally by the numeral 100 in FIGS. 1 and 2. Container 100 generally includes a first base 102 that supports a pair (first and second) of contact lens receptacles 104. Each receptacle 104 defines a chamber that holds a liquid contact lens multi-purpose cleaning solution 106. Each chamber is sized to receive a contact lens (approximately 5 mm to 25 mm diameter) within the chamber completely submerged in solution 106. A removable seal 108 is connected to base 102 or receptacle 104 to seal each chamber to prevent solution 106 from leaking from receptacle 104. Seal 108 may be a plastic, a metal foil, or a metalized plastic adhered to or welded to base 102 to seal each chamber to prevent leaking. A portion of seal 108 may be unattached to base 102 so that the user can grip seal 108 start peeling seal 108 away from base 102. Container 100 also includes a lid 110 adapted to move to a closed position with respect to each receptacle 104 to seal the chambers after seal 108 has been removed and the lenses have been placed in solution 106.

In the first embodiment of the invention, the first and second contact lens receptacles 104 are connected together with a first living hinge 112. A second living hinge 114 connects lid 110 to one of receptacles 104. Living hinges 112 and 114 allow lid 110 to be folded over on top of the adjacent receptacle with the combination lid/receptacle then being folded over on top of the other receptacle. Hinge 112 may be a pair of spaced living hinges. Lid 110 thus extends from the top and the bottom of base 102 so that lid 110 may be sandwiched between receptacles 104 when container 100 is closed.

Each receptacle 104 has a flat bottom or stand-offs 116 to support container 100 on a flat surface when the user is removing seal 108, placing the lenses in the chambers, and closing lid 110. Each upper surface lip or rim of receptacles 104 is configured to lock with lid 110 with a leak-proof snap fit.

Container 100 also may include a holding clip 120 that cooperates with a locking clip 122 when lid 110 is closed.

Figure 3:
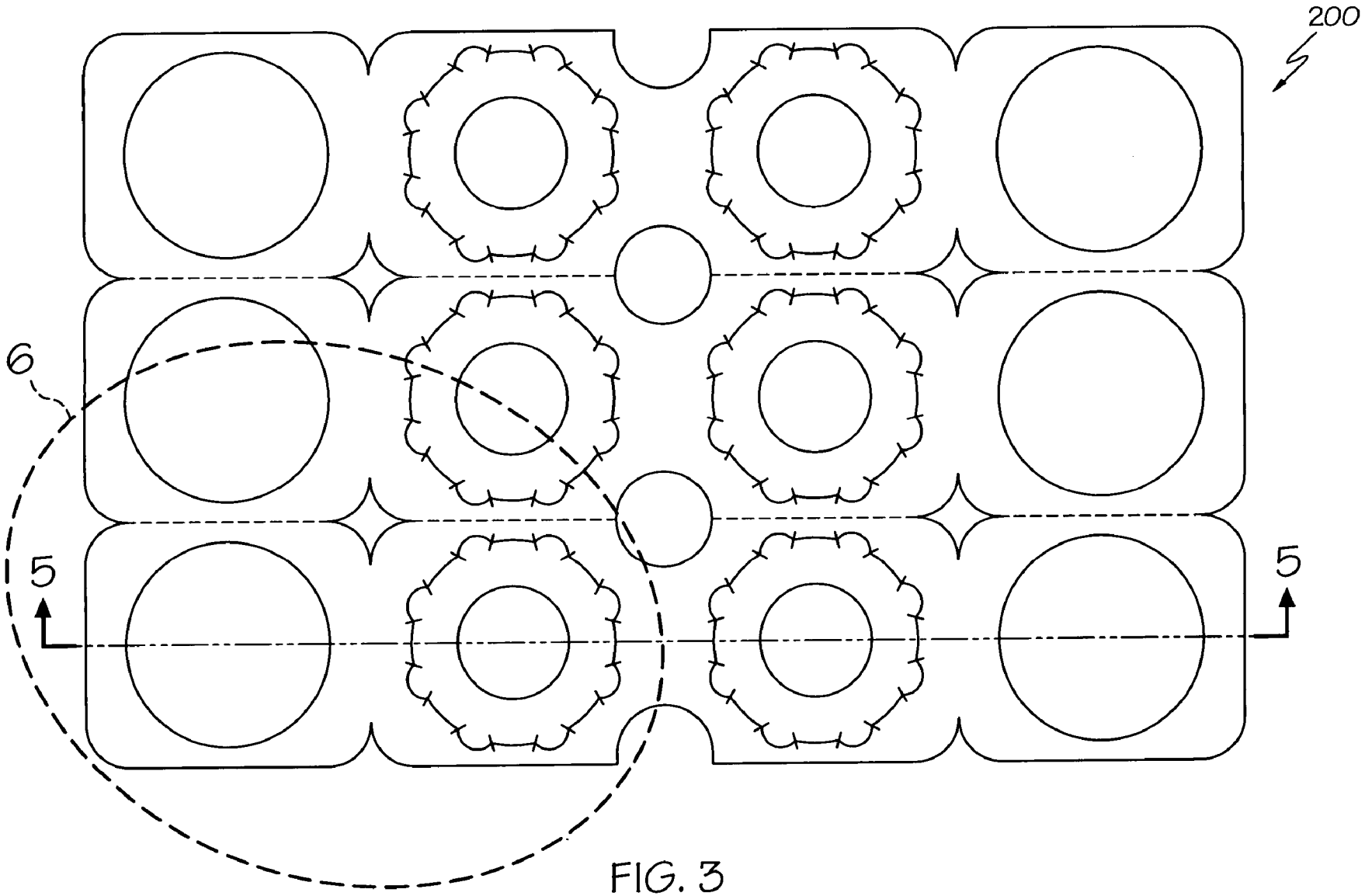
FIG. 3 is a top plan view of a second embodiment of the invention.
Figure 4:
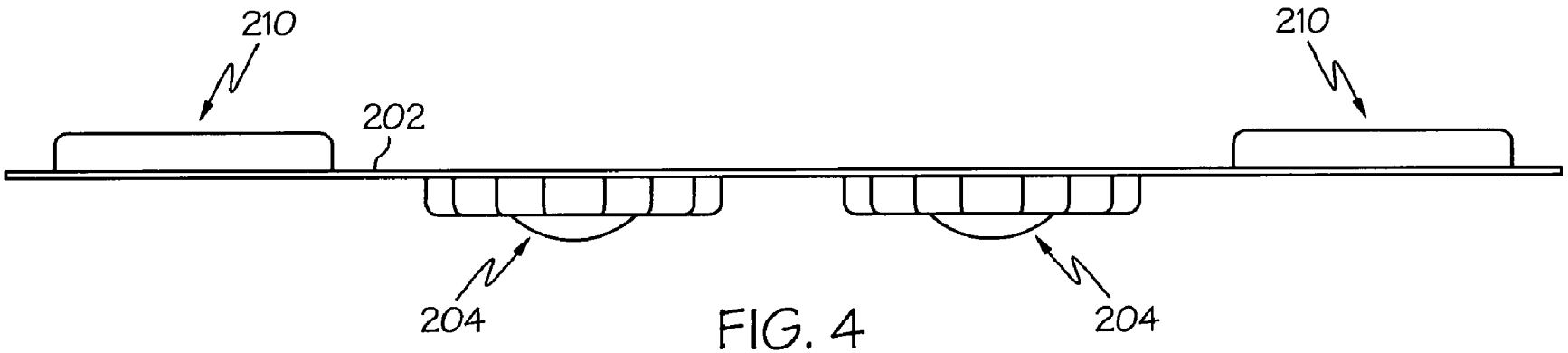
FIG. 4 is a side view of the second embodiment of the invention.
Figure 5:
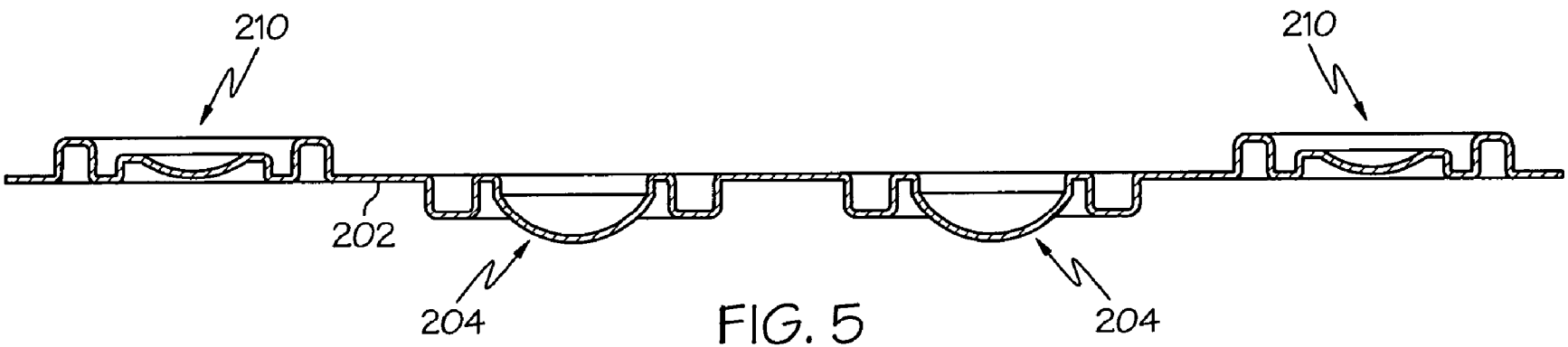
FIG. 5 is a section view taken along line A-A of FIG. 3.
Figure 6:
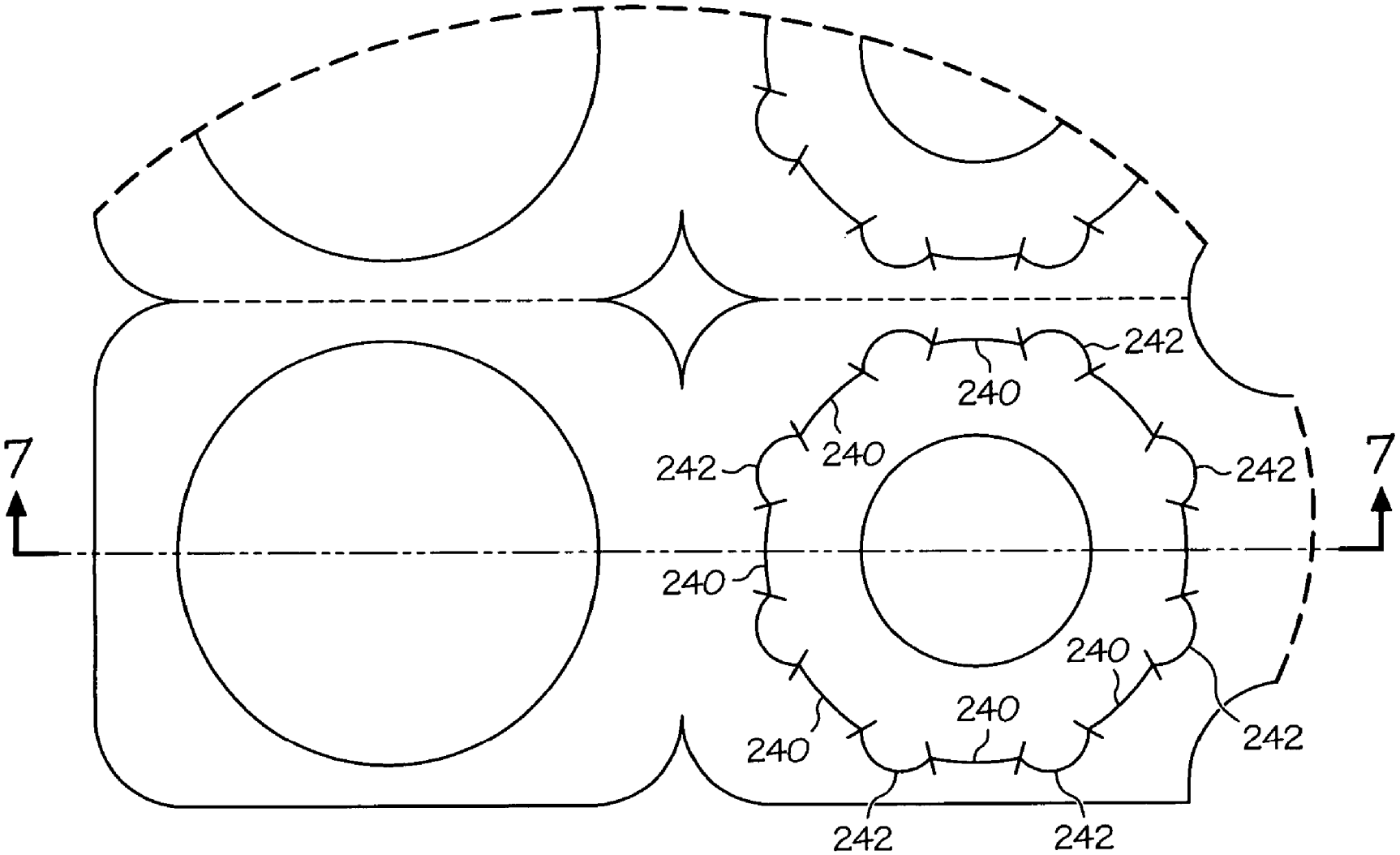
FIG. 6 is an enlarged view of the encircled portion of FIG. 3.
Figure 7:
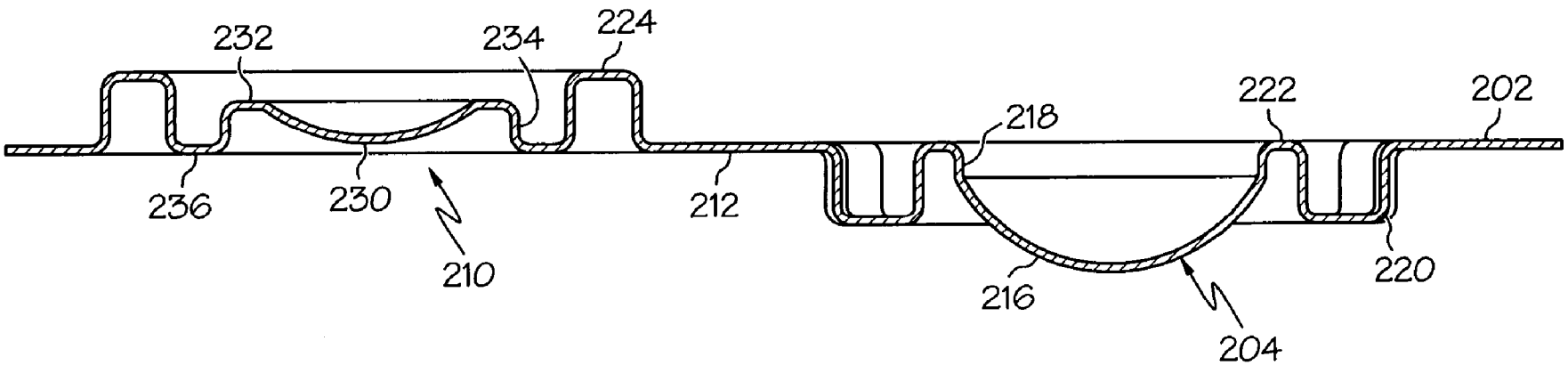
FIG. 7 is a section view taken along line A-A of FIG. 6.
Figure 8:
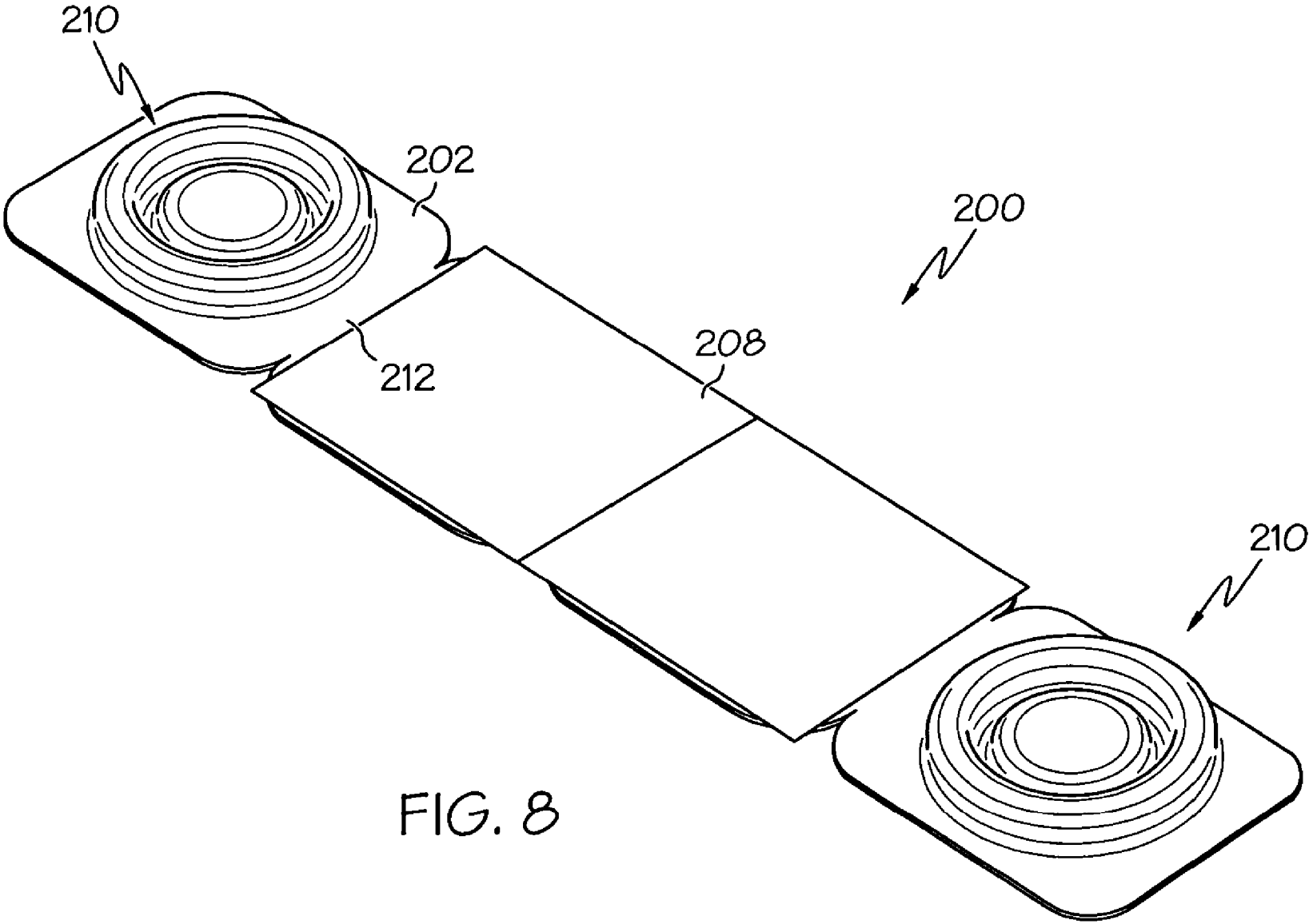
FIG. 8 is a perspective view of the second embodiment of the invention with both receptacles sealed.
Figure 9:
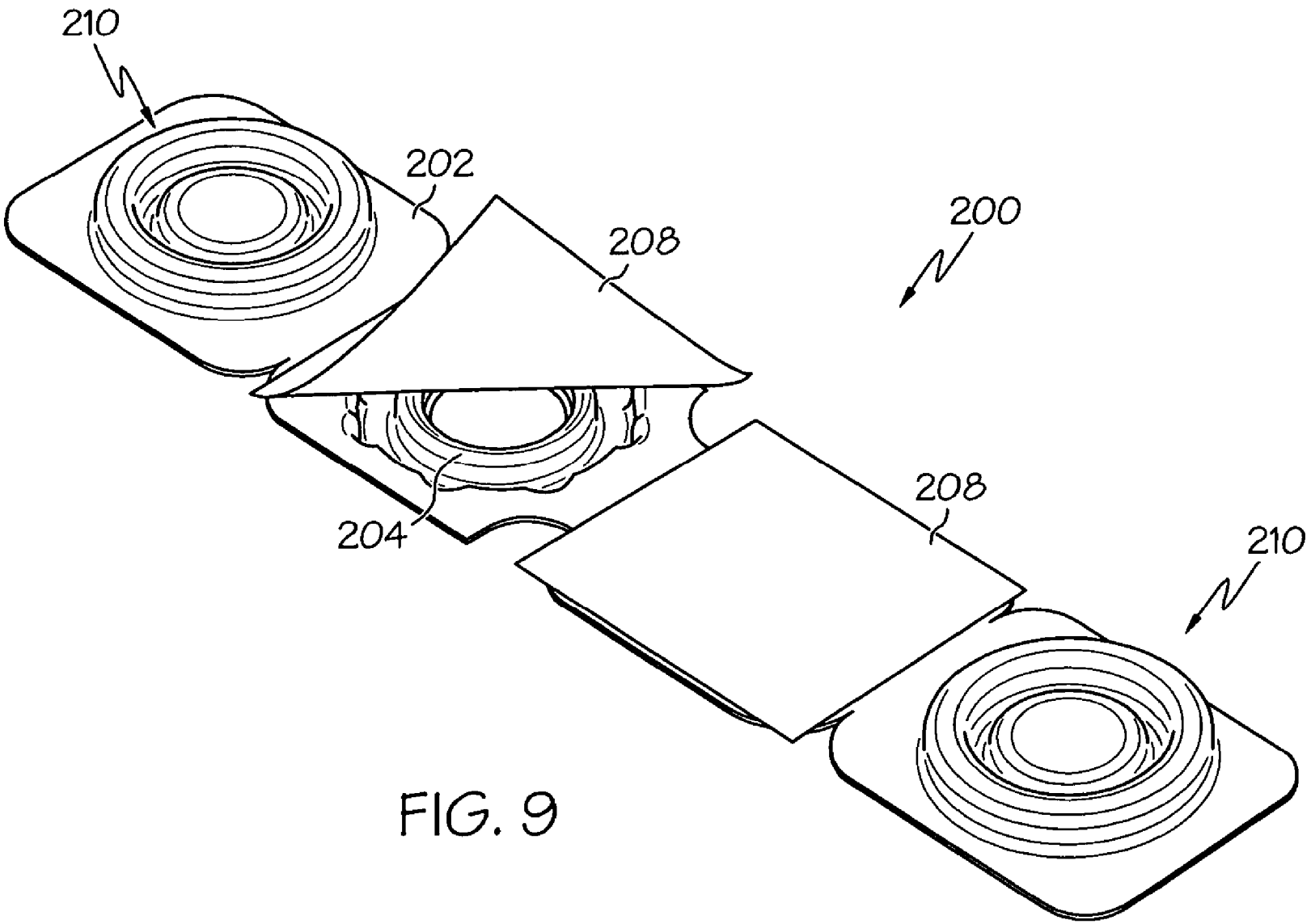
FIG. 9 is a perspective view of the second embodiment of the invention with one receptacle sealed and the other receptacle in the process of being unsealed.
Figure 10:
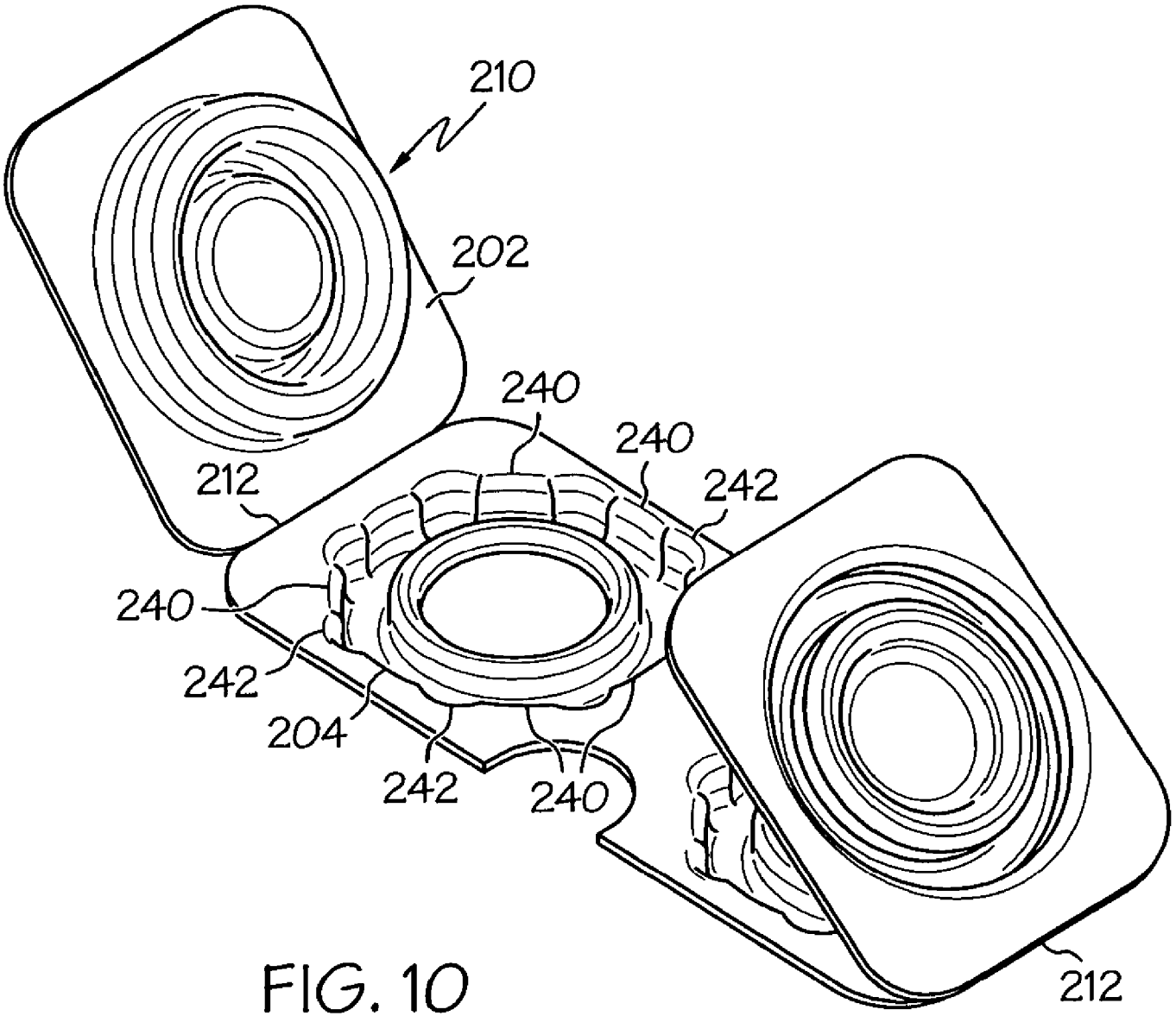
FIG. 10 is a perspective view of the second embodiment of the invention showing one of the lids in the process of being closed.
Figure 11:
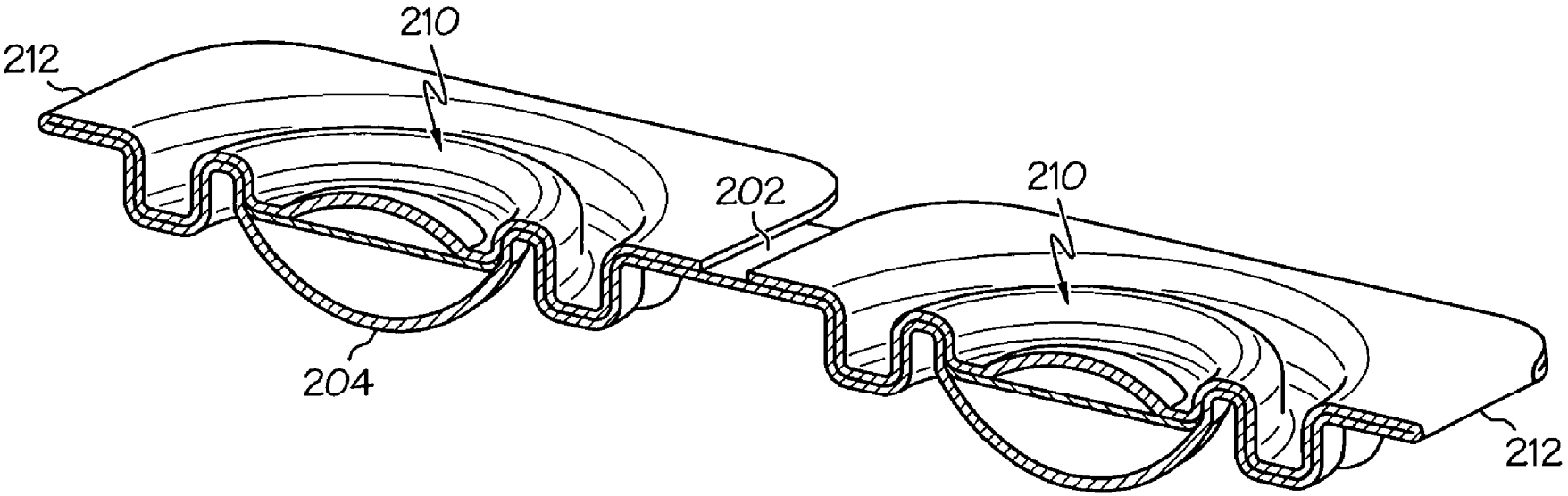
FIG. 11 is a perspective view of the second embodiment of the invention showing both of the receptacles closed with the lids.

The second configuration of the container of the invention is indicated generally by the numeral 200 in FIGS. 3 and 11. Container 200 generally includes a first base 202 that supports at least one contact lens receptacle 204. First base 202 may be connected to a second similar base that defines a second contact lens receptacle 204. Each receptacle 204 is integrally formed from the material of body 202. Each receptacle 204 defines a chamber that holds a liquid contact lens multi-purpose cleaning solution. Each chamber is sized to receive a contact lens (approximately 5 mm to 25 mm diameter) within the chamber completely submerged in the solution. A removable seal 208 is connected to base 202 to seal each chamber to prevent the solution from leaking from receptacle 204. Seal 208 may be a plastic, a metal foil, or a metalized plastic removably connected to base 202 to seal each chamber to prevent leaking. A portion of seal 208 may be unattached to base 202 so that the user can start peeling seal 208 away from base 202. Container 200 also includes a lid 210 associated with each receptacle 204. Each lid 210 is adapted to move to a closed position with respect to its receptacle 204 to seal the chambers after seal 208 has been removed and the lenses have been placed in the solution. In the second embodiment of the invention, each receptacle 204 is connected to a lid 210 with a living hinge 212.

In this configuration, each receptacle has a curved lower wall 216 and a cylindrical sidewall 218. Each receptacle 204 is surrounded by a ring-shaped depression 220 spaced from receptacle 204 by a flat landing annular portion 222 of base 202. Lid 210 includes a ring-shaped protrusion 224 that is configured to snap fit into depression 220 such that lid 210 seals receptacle 204 as shown in FIG. 11. Each lid 210 has a curved central portion 230 that is curved in the opposite direction of curved lower wall 216 when container 200 is closed. A flat ring 232 surrounds portion 230 and connects to a cylindrical wall 234 that frictionally fits inside sidewall 218. A flat annular portion 236 connects wall 234 to protrusion 224.

In the exemplary embodiment of the invention, depression 220 has an outer wall formed from a plurality of curved wall portions 240 that are substantially concentric with sidewall 218 and a plurality of notch walls 242 that connect the ends of wall portions 240. Walls 242 allow wall portions 240 to flex when protrusion 224 is forced into depression 220. The combination of walls 240 and 242 create a biasing force that helps seal the chamber when lid 210 is closed.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A pre-filled contact lens container comprising:

a first base defining at least a first contact lens receptacle, an annular portion surrounding the first contact lens receptacle, and a ring-shaped depression surrounding the annular portion;

a contact lens multi-purpose solution disposed in the first contact lens receptacle;

a removable single-use, receptacle seal connected to the base to seal the contact lens multi-purpose solution in the first contact lens receptacle;

a first lid pivotably connected to the base and movable between an open condition and a closed condition with respect to the base; the first lid defining a ring-shaped protrusion configured to snap fit into the ring-shaped depression of the first base to secure the lid in the closed condition; and the first lid cooperating with the base when the first lid is in the closed condition to seal the first contact lens receptacle after the removable, single-use, receptacle seal has been removed.

2. The container of claim 1, wherein the portion of the first base defining the first contact lens receptacle includes a lower wall and a sidewall; the first lid defining a central portion having a wall that frictionally engages the sidewall of the first base when the first lid is in the closed condition to secure the first lid in the closed condition and seal the first contact lens receptacle.

3. A pre-filled contact lens container comprising:

a first base defining at least a first contact lens receptacle: the portion of the first base defining the first contact lens receptacle including a lower wall and a sidewall;

a contact lens multi-purpose solution disposed in the first contact lens receptacle;

a removable single-use, receptacle seal connected to the base to seal the contact lens multi-purpose solution in the first contact lens receptacle;

a first lid pivotably connected to the base and movable between an open condition and a closed condition with respect to the base;

the first lid cooperating with the base when the first lid is in the closed condition to seal the first contact lens receptacle after the removable, single-use, receptacle seal has been removed;

the first lid defining a central portion having a wall that frictionally engages the sidewall of the first base when the first lid is in the closed condition to secure the first lid in the closed condition and seal the first contact lens receptacle;

the first base including a flat landing annular portion surrounding the receptacle; and the first base defining a ring-shaped depression surrounding the flat landing annular portion and the first lid defining a ring-shaped protrusion configured to snap fit into the ring-shaped depression of the first base to secure the lid in the closed condition and seal the receptacle.

4. The container of claim 3, wherein the sidewall of the first base is cylindrical in shape and the wall of the first lid is cylindrical in shape.

5. The container of claim 4, wherein the lower wall of the first base is curved and the central portion of the first lid is curved; the lower wall of the first base being concave with respect to the contact lens multi-purpose solution disposed in the receptacle; and the central portion of the first lid being concave with respect to the contact lens multi-purpose solution disposed in receptacle when the first lid is closed.

6. The container of claim 3, wherein the ring-shaped protrusion of the first lid is spaced from the central portion of the first lid by a flat annular portion; the flat annular portion of the first lid being disposed against the flat landing annular portion of the first base when the first lid is in the closed condition.

7. The container of claim 3, wherein the ring-shaped depression of the first base is at least partially defined by an outer wall that is defined by a plurality of curved wall portions and a plurality of notch walls; the curved wall portions and notch walls alternating about the outer wall.

8. The container of claim 7, wherein the notch walls allow the curved wall portions to flex to allow the first base to receive the ring-shaped protrusion of the first lid in a releasable snap fit.

9. The container of claim 3, further comprising a second base defining a second contact lens receptacle;

a contact lens multi-purpose solution disposed in the second receptacle;

a removable single-use, receptacle seal connected to the second base to seal the contact lens multi-purpose solution in the second receptacle;

a second lid pivotably connected to the second base about a second living hinge between an open condition and a closed condition with respect to the second base;

the second lid cooperating with the second base when the second lid is in the closed condition to seal the second receptacle after the removable, single-use, receptacle seal has been removed; and the second base being connected to the first base.

10. The container of claim 9, wherein the combined first and second bases define a perforated line to allow the first base to be separated from the second base.

11. A pre-filled contact lens container comprising:

a first base defining at least a first contact lens receptacle;

a contact lens multi-purpose solution disposed in the first contact lens receptacle;

the first base including a landing annular portion surrounding the receptacle;

the first base defining a ring-shaped depression surrounding the landing annular portion;

a removable single-use, receptacle seal connected to the base to seal the contact lens multi-purpose solution in the first contact lens receptacle;

a first lid pivotably connected to the base and movable between an open condition and a closed condition with respect to the base; and the first lid defining a ring-shaped protrusion configured to snap fit into the ring-shaped depression of the first base to secure the first lid in the closed condition and seal the first contact lens receptacle.

12. The container of claim 11, wherein the portion of the base defining the first contact lens receptacle includes a lower wall and a sidewall; the first lid defining a central portion having a wall that frictionally engages the sidewall of the base when the first lid is in the closed condition to secure the first lid in the closed condition and seal the first contact lens receptacle.

13. The container of claim 12, wherein the ring-shaped depression of the first base is at least partially defined by an outer wall that is defined by a plurality of curved wall portions and a plurality of notch walls; the curved wall portions and notch walls alternating about the outer wall.

* * * * *